US009630088B2

(12) United States Patent
Walker, Jr.

(10) Patent No.: US 9,630,088 B2
(45) Date of Patent: Apr. 25, 2017

(54) GAME SYSTEM

(71) Applicant: Wilmer David Walker, Jr., Atlanta, GA (US)

(72) Inventor: Wilmer David Walker, Jr., Atlanta, GA (US)

( * ) Notice: Subject to any disclaimer, the term of this patent is extended or adjusted under 35 U.S.C. 154(b) by 93 days.

(21) Appl. No.: 14/677,793

(22) Filed: Apr. 2, 2015

(65) Prior Publication Data

US 2016/0287978 A1 Oct. 6, 2016

(51) Int. Cl.

| | |
|---|---|
| ***A63F 9/14*** | (2006.01) |
| ***A63F 7/36*** | (2006.01) |
| *A63F 3/00* | (2006.01) |
| *A63F 9/24* | (2006.01) |
| *A63F 11/00* | (2006.01) |

(52) U.S. Cl.

CPC .. *A63F 7/3622* (2013.01); *A63F 2003/00347* (2013.01); *A63F 2009/2452* (2013.01); *A63F 2009/2472* (2013.01); *A63F 2011/0079* (2013.01); *A63F 2250/49* (2013.01)

(58) Field of Classification Search

CPC ..... A63H 33/38; A63H 19/24; A47G 9/10; A63F 7/28; A63F 7/386; A63F 2007/282; A63F 2007/286; A63F 9/14; A63F 7/38; A63F 2250/49; A63F 7/04; A63F 7/3622; A63F 2003/00347

USPC ..... 446/465, 431, 476, 397, 444, 227, 446, 446/135, 148, 445, 71, 168–174, 26–28, 446/489; 246/3; 104/269.298; 273/26–28, 109–117, 168–170, DIG. 19, 273/441–444; 221/288; 463/69; 472/133

See application file for complete search history.

(56) References Cited

U.S. PATENT DOCUMENTS

| | | | | | |
|---|---|---|---|---|---|
| 588,988 | A * | 8/1897 | Harrington | A63F 9/14 | 273/110 |
| 2,401,455 | A * | 6/1946 | Bezark | A63H 11/04 | 446/170 |
| 3,658,333 | A * | 4/1972 | Carcel | A63F 9/14 | 463/69 |
| 3,836,143 | A * | 9/1974 | Trent | A63B 47/001 | 124/79 |
| 4,236,714 | A * | 12/1980 | Locke | A63F 3/00041 | 273/238 |
| 4,311,310 | A * | 1/1982 | Dankman | A63F 7/041 | 273/109 |
| 4,673,182 | A * | 6/1987 | Bowen | A63F 9/14 | 104/305 |

(Continued)

OTHER PUBLICATIONS

Wooden Grooved Pediatric Manipulative Mazes, RehabMart, http://www.rehabmart.com/product/wooden-grooved-pediatric-manipulative-mazes-35672.html, captured May 9, 2012.*

(Continued)

*Primary Examiner* — Melba Bumgarner
*Assistant Examiner* — Laura L Davison
(74) *Attorney, Agent, or Firm* — Thomas B. McGurk

(57) ABSTRACT

A game system is disclosed that can be played using gross motor skills. The game system is mountable on a portion of a user's body and includes a track along which a playing figure can be propelled by movement of the player's body. The game system can include detachable templates that include tracks of varying difficulty.

7 Claims, 9 Drawing Sheets

(56) References Cited

U.S. PATENT DOCUMENTS

| | | | | | |
|---|---|---|---|---|---|
| 4,674,987 | A * | 6/1987 | Sober | A63B 21/0608 | 446/170 |
| 4,744,563 | A * | 5/1988 | Anastasia | A63F 7/04 | 273/116 |
| 4,874,340 | A * | 10/1989 | Smallwood | 446/28 | |
| 5,678,789 | A * | 10/1997 | Pipich | 246/3 | |
| 5,968,599 | A * | 10/1999 | Jung et al. | 427/393.4 | |
| 6,220,917 | B1 * | 4/2001 | Nelson | A63H 33/00 | 273/115 |
| 2004/0036211 | A1 * | 2/2004 | Oister | A63F 7/06 | 273/108.1 |
| 2006/0175750 | A1 * | 8/2006 | Ware | A63F 7/2436 | 273/120 A |

OTHER PUBLICATIONS

My Busy Town, Alex Toys, reviewed by Parenting.com, http://www.parenting.com/gallery/best-baby-toddler-toys?, captured Nov. 22, 2011.*

University of Toronto Scientific Instruments Collection, Wooden Maze, Accession No. 2012.psy.137, published Jan. 30, 2013 at http://utsic.escalator.utoronto.ca/home/blog/instrument/wooden-maze-2/.*

KidKraft Bead Maze Cube Model No. 63243, published on Jun. 3, 2010, at https://www.kidkraft.com/bead-maze-cube-63243.html.*

* cited by examiner

GAME SYSTEM

TECHNOLOGICAL FIELD

The present disclosure relates to games and entertainment devices and, more particularly, to game systems employing gross motor skills.

BACKGROUND

Games and entertainment devices today are often geared to relatively passive play, requiring only fine motor skills, wherein the user's hands alone direct the course of play. Such games and entertainment devices allow for play to occur without the player engaging in much body movement, thereby further contributing to maintenance of a sedentary level of activity even when an individual is engaged in play. The design of such games also tends to favor those players whose fine motor skills have fully developed and not yet waned. Thus, when a group that includes individuals of varying levels of fine motor skills, such as a family, is selecting a game to play as a group, such games tend to make for poor choices as they hinder effective competition by those whose fine motor skills are not comparable to others with optimal fine motor skills. Furthermore, such games typically do not provide a role for the spectators to impact or enhance the game play and the general level of excitement surrounding the game. Accordingly, there is a need for a game system that potentially can address one or more of the shortcomings of the typical game.

SUMMARY

The present disclosure encompasses game systems in which players can play the systems by moving various portions of their bodies. The game system can comprise a base, a body connector connected to the base, whereby the body connector is capable of engaging a portion of a player's body to mount the game system on the player's body, a template connected to the base, wherein the template comprises a track, a playing figure, and a retainer connected to the playing figure, wherein the retainer is movably connected to the track, whereby the playing figure is movable along the track. In one aspect, the body connector can comprise a strap that can be placed around a portion of the player's body, such as the torso, so as to mount the game system on the player's back. In another aspect, the game system can comprise a sensor operably aligned with the track, whereby the sensor activates when the playing figure is aligned at a predetermined position along the track. In yet another aspect, the game system can further comprise at least one light operably connected to the sensor, whereby the light is activated when the sensor is activated. In a further aspect, the template can comprise a plurality of pieces, wherein the plurality of pieces cooperates to define the track. In still a further aspect, the track can comprise a start seat, whereby the start seat engages the retainer to maintain the retainer in a stationary position. In another aspect, the template further can comprise at least one first fastener element. In yet another aspect, the base further can comprise at least one second fastener element, wherein the at least one first fastener element engages the at least one second fastener element to connect the template to the base. In a further aspect, the second fastener element can comprise a post. In still a further aspect, the track can comprise at least one nonlinear section that can comprise at least one bend or meander. In another aspect, the track can comprise a channel, and wherein at least a portion of the retainer is movably disposed within the channel. In a further aspect, the template can comprise a first opening disposed adjacent a first end of the track, and wherein the retainer is detachable from the template at the first opening. In yet another aspect, the template further can comprise a second opening disposed adjacent a second end of the track, and wherein the retainer is detachable from the template at the second opening. In another aspect, the template can be detachably connected to the base.

The present disclosure also comprises a game system comprising a base supporting a track having a first end and a second end, a body connector connected to the base, wherein the body connector is capable of connecting the base to the torso of a player, a playing figure movably engaged to the track, wherein the playing figure is movable between the first end and the second end of the track, and, a sensor operably aligned with a predetermined portion of the track, whereby the sensor activates when the playing figure is aligned with the predetermined portion of the track. In one aspect, the game system further can comprise an alarm operably engaged to the sensor, whereby the alarm activates when the sensor activates. In another aspect, the track is detachably connected to the base.

The present disclosure also encompasses a game system comprising a base, a strap connected to the base, whereby the strap is capable of connecting the base to the torso of a player, a template detachably connected to the base, wherein the template comprises a first plate and a second plate, wherein the first plate and the second plate are aligned to define a channel between the first plate and the second plate, a playing figure comprising a body and a retainer attached to the body, wherein at least a portion of the retainer is disposed in the channel when the playing figure is movably engaged with the template, and, a sensor operably aligned with a predetermined portion of the channel, whereby the sensor activates when the playing figure is aligned with the predetermined portion of the channel.

These and other aspects of the present disclosure are set forth in greater detail below and in the drawings for which a brief description is provided as follows.

DETAILED DESCRIPTION

The present disclosure is directed to game systems that can be mounted on a portion of a player's body, such as the player's back. The game systems of the present disclosure can be configured for the player to use gross motor skills and move major muscle groups, such as those of the torso and legs, during game play. In some embodiments, the game systems can include configurations that vary in skill level to allow users of various ages and ability to play effectively. These various configurations can include more than one template detachably connected to the base of the game platform.

As used herein, the term "alarm" refers to any light, noisemaker, vibrating system or other notification system by which a player or other game participant can be notified of the occurrence of a game event.

Figure 1:
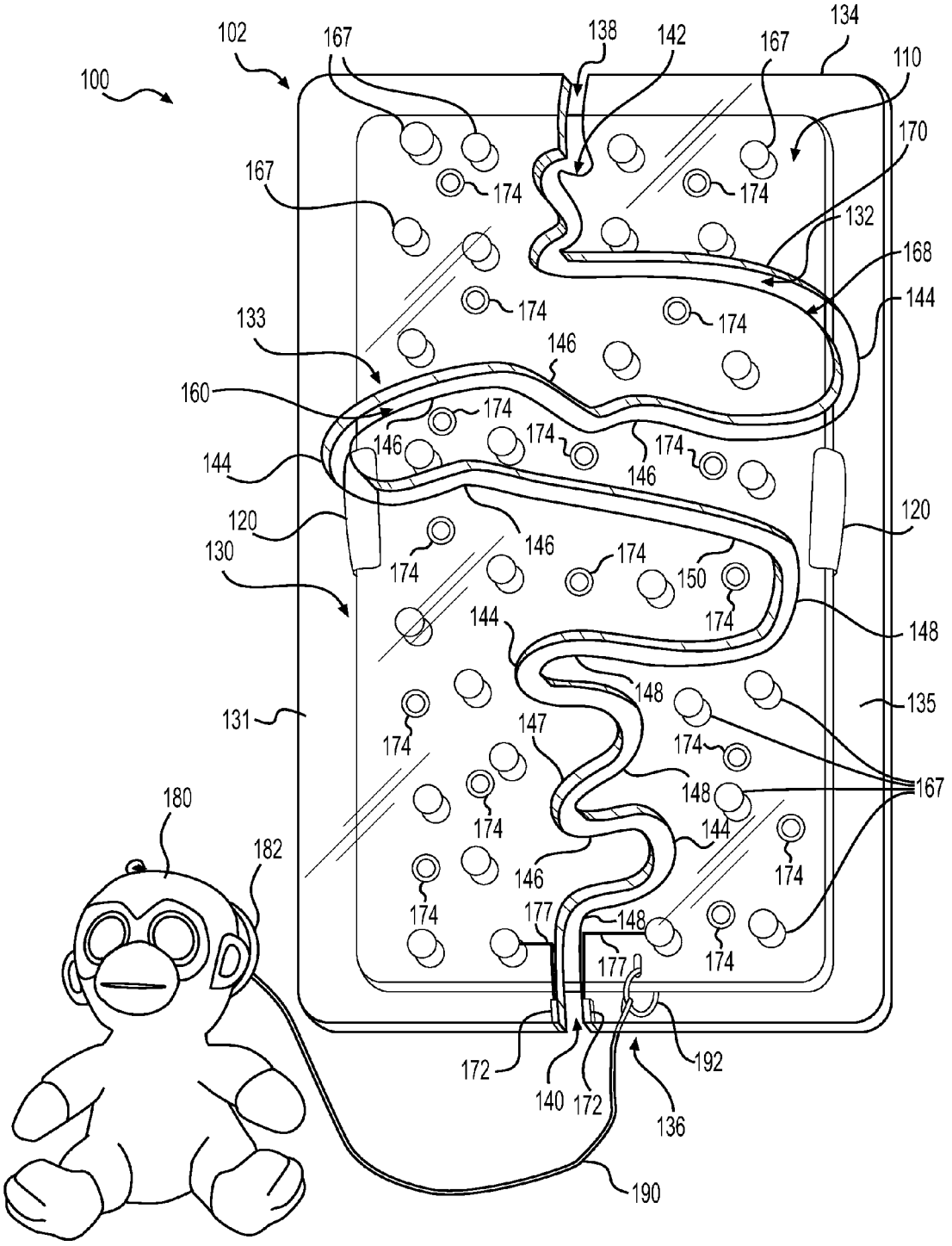
FIG. 1 is a perspective view of a game system encompassing aspects of the present disclosure.

FIG. 1 show a game system 100 encompassing aspects of the present disclosure. The game system 100 includes a game platform 102 and a movable playing figure 180. The playing figure 180 can be movably connected to the game platform 102 to allow the player to move the playing figure 180 along a track 133 provided on the game platform 102 during game play. The playing figure 180 can be connected to the game platform 102 by a flexible connector 190, such as a string, cord, or the like attached to a ring 192 mounted on the base 110. The game platform 102 comprises a base 110, a body connector 120 attached to the base 110, and a template 130 mounted on the base 110. The game platform 102 can be mounted to a player's body by engaging the player's body with the body connector 120, which can be a belt, strap, band or similar structure that allows for securing of the game platform 102 to a part of a player's body.

The template 130 includes a track 133 around which the playing figure 180 moves as the game system 100 is played. The template 110 includes a first template piece 131 and a second template piece 135, each of which is mounted on the base 110 and cooperate to form a channel 132 that defines the track 133. The game systems encompassed by the present disclosure can include templates made from one, two or more pieces. The template 130 can be translucent so as to make visible the lights 174 mounted on the base 110.

Figure 2:
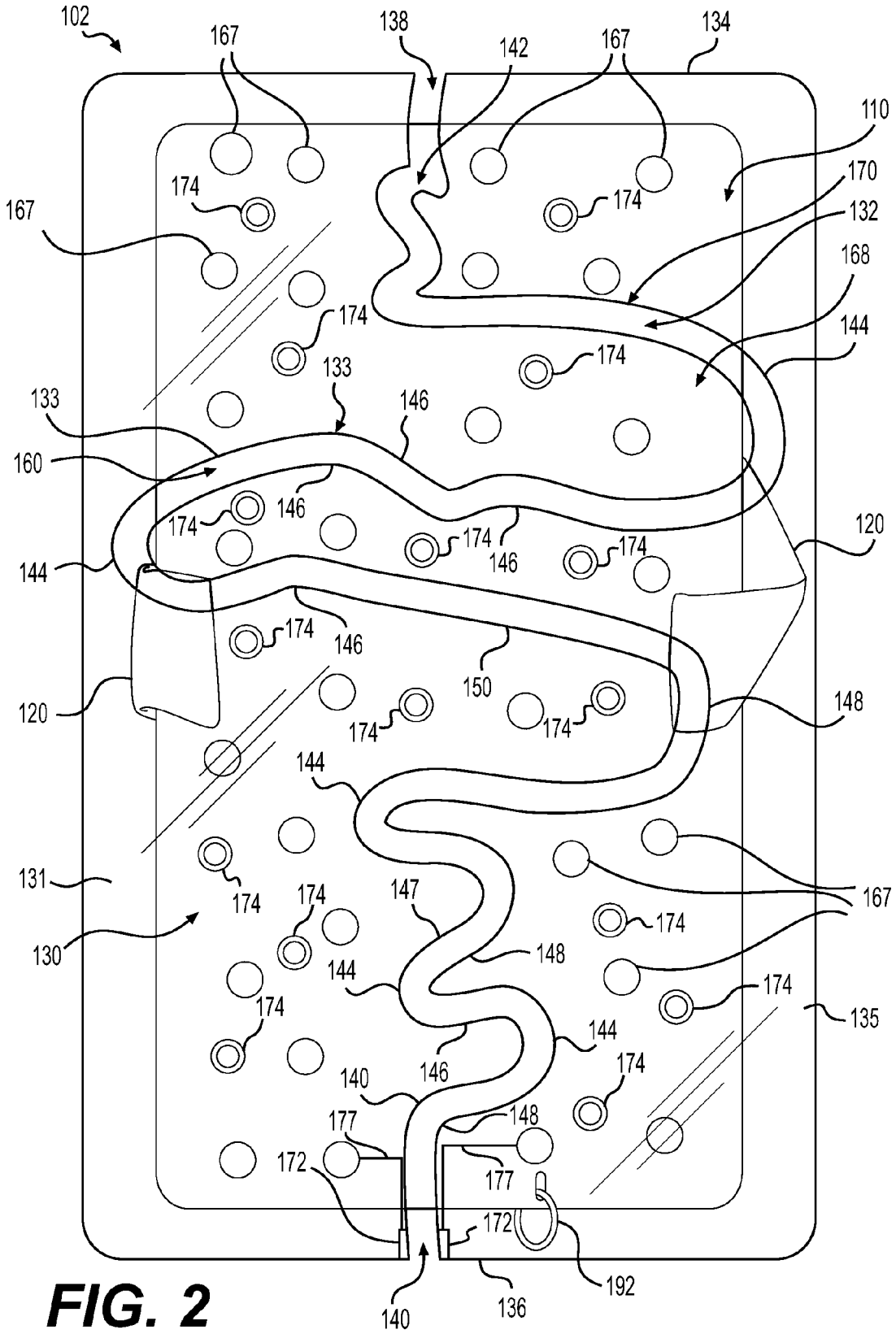
FIG. 2 is a front elevation view of the game platform of the game system shown in FIG. 1.
Figure 3:
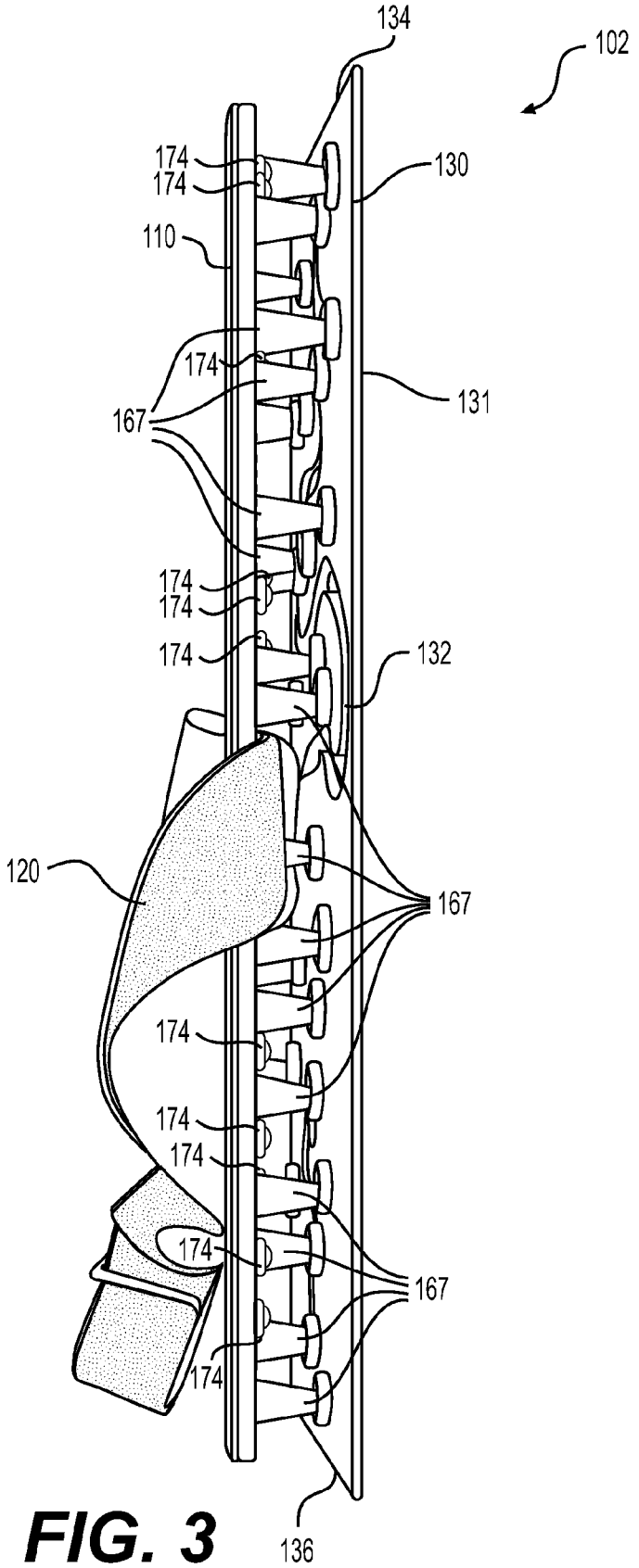
FIG. 3 is a side perspective view of the game platform shown in FIG. 2.
Figure 4A:
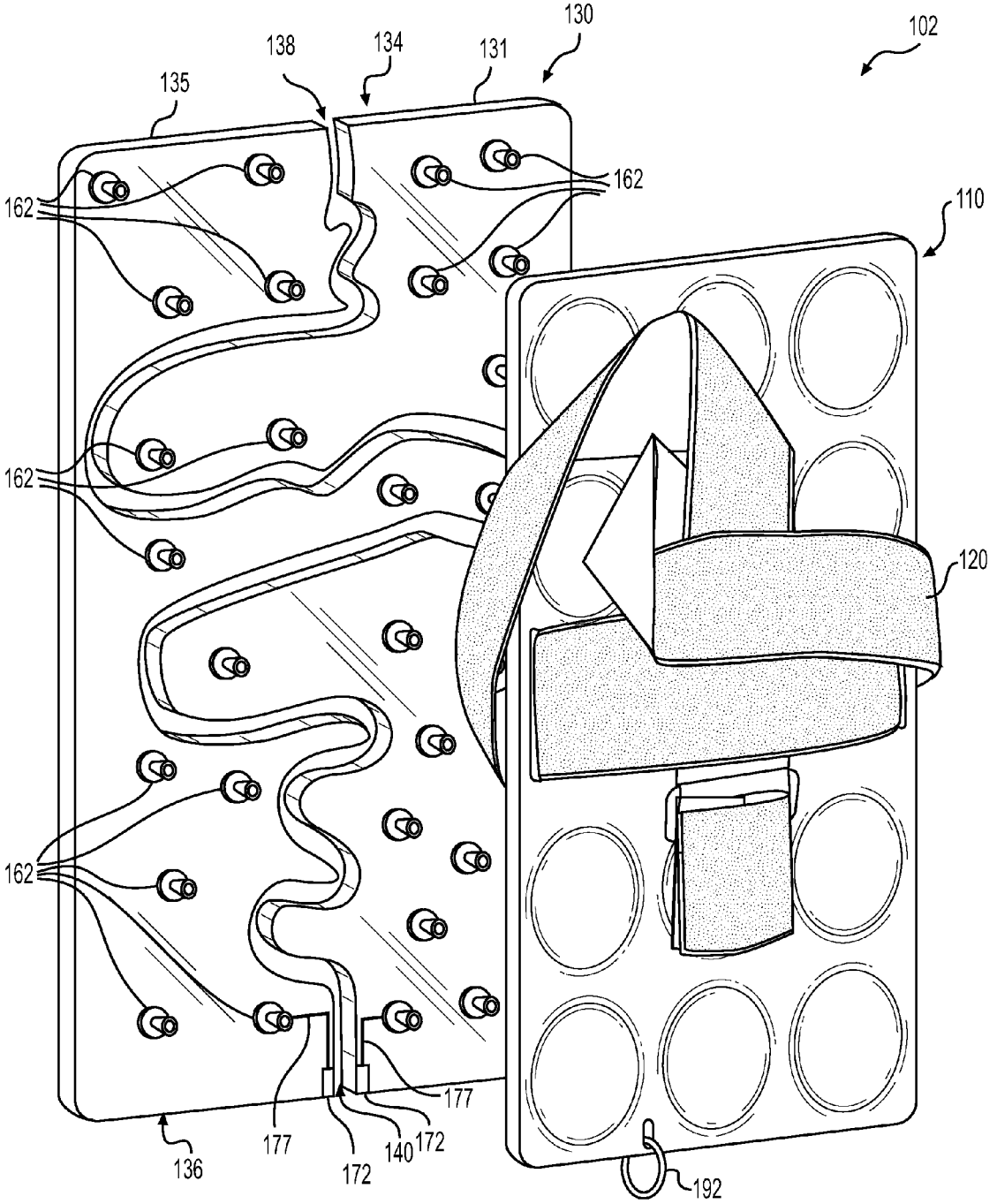
FIG. 4A is a perspective view of the game platform shown in FIG. 2 with the template separated from the base thereof.
Figure 4B:
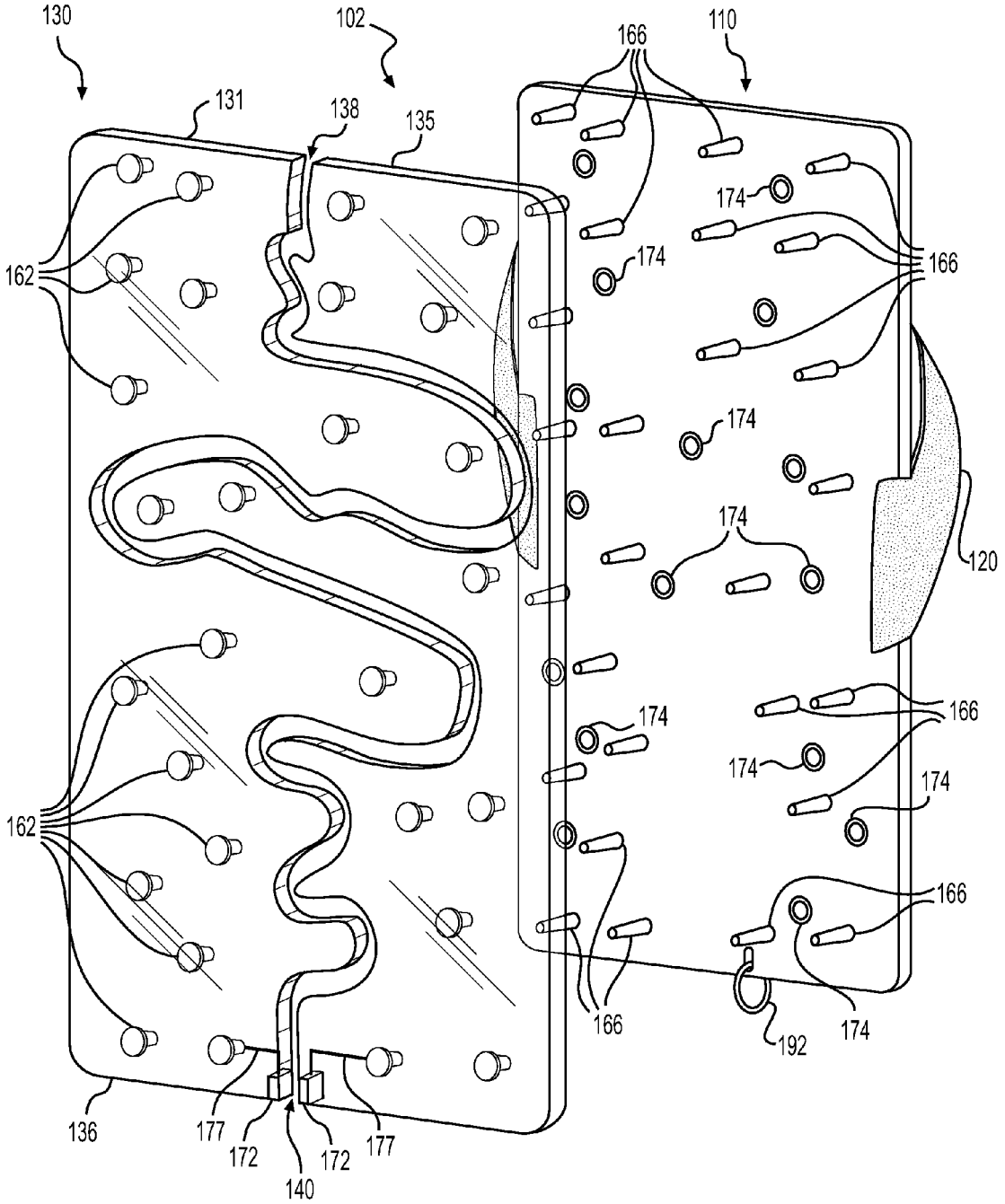
FIG. 4B is another perspective view of the game platform shown in FIG. 4A with the template separated from the base thereof.

As shown in FIGS. 1 and 2, the channel 132 includes a first opening 138 aligned proximal to a first side 134 of the template 130 and a second opening 140 aligned proximal to a second side 136 of the template 130. Between the first and the second openings 138 and 140, the channel 132 defines a tortuous path 160 that can include one or more bends 144, rises 146, drops 148, slopes 150 and meanders 147. The channel 132 also can include a starting seat 142 where the playing figure 180 can be aligned in a stable position at the start of game play. Operably aligned with the channel 132 are one or more sensors 172. As shown in FIGS. 1 and 2, the sensors 172 are aligned adjacent the second opening 140 of the channel 132 to provide means for detecting when the playing figure 180 has moved to the end of the track 133 and, thus completed the game play. The sensors 172 can be electrically energized so as to generate an electric signal or break an electric circuit when the playing figure 180 moves to the predetermined position along the track 133. Alternatively, the sensors 172 can be configured to activate mechanically when the playing figure 180 moves into a predetermined position. The sensors 172 can be operably connected to one or more alarms, such as battery-operated lights 174, mounted to the base 110 of the game platform 102 and operably connected to the sensors 172 by wires 177. The lights 174 can be activated or deactivated as desired when the sensors 172 are activated and connected to a battery, not shown, mounted in the base 110. The sensors 172 also can be operably connected to one or more other alarms, such as bells, buzzers, chimes or the like that can be activated upon activation of the sensors 172, thereby notifying the player and other game participants that the playing figure 180 has moved to the predetermined position along the track with which the sensors 172 are operably aligned. Although sensors 172 are shown operably aligned adjacent the end of the track 133, the present disclosure also encompasses game systems that include sensors operably aligned at intermediate points along the track between the starting and finish points, so as to allow for the notification of the player and other participants of the progress of the playing figure 180 along the track 133 during game play. The present disclosure encompasses game systems that include tracks with alternative configurations from the channel 132 shown in FIG. 1. For example, the track can comprise a rail that defines a path along which the playing figure moves during play.

As shown in FIGS. 1-4B, the template 130 is detachably connected to the base 110 by a plurality of connectors 167. Each of the connectors 167 can comprise a female sleeve 162 mounted on the template 130 and a male post 166 mounted on the base 110 of the game platform 102. Each sleeve 162 can mate with a post 166 to secure the template 130 to the base 110. The present disclosure also encompasses game systems in which the templates are connected to the bases thereof by alternative fastening systems. The body connector 120 attached to the base 110 of the game platform 102 can comprise an adjustable strap that can fasten around a limb or the torso of a player in order to mount the game platform 102 to the player's body for game play.

Figure 5A:
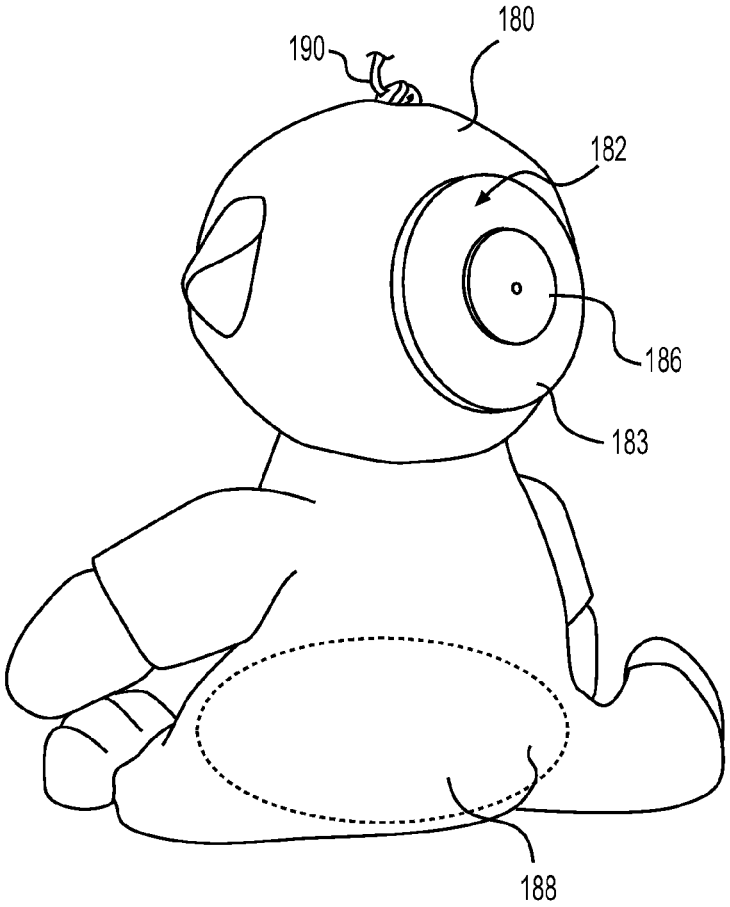
FIG. 5A is a rear perspective view of the playing figure of the game system shown in FIG. 1.
Figure 5B:
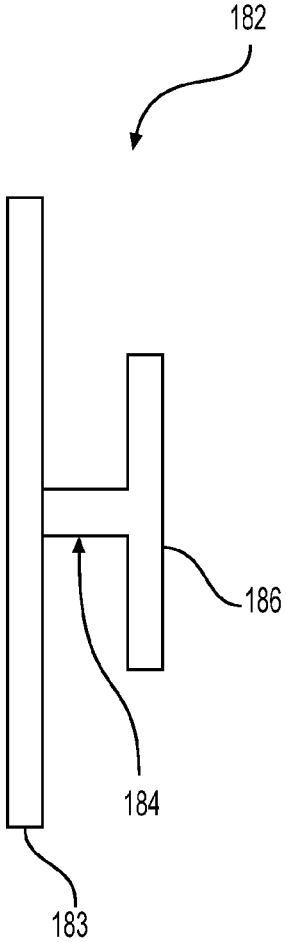
FIG. 5B is a side elevation view of the retainer shown in FIG. 5A detached from the playing figure.
Figure 7:
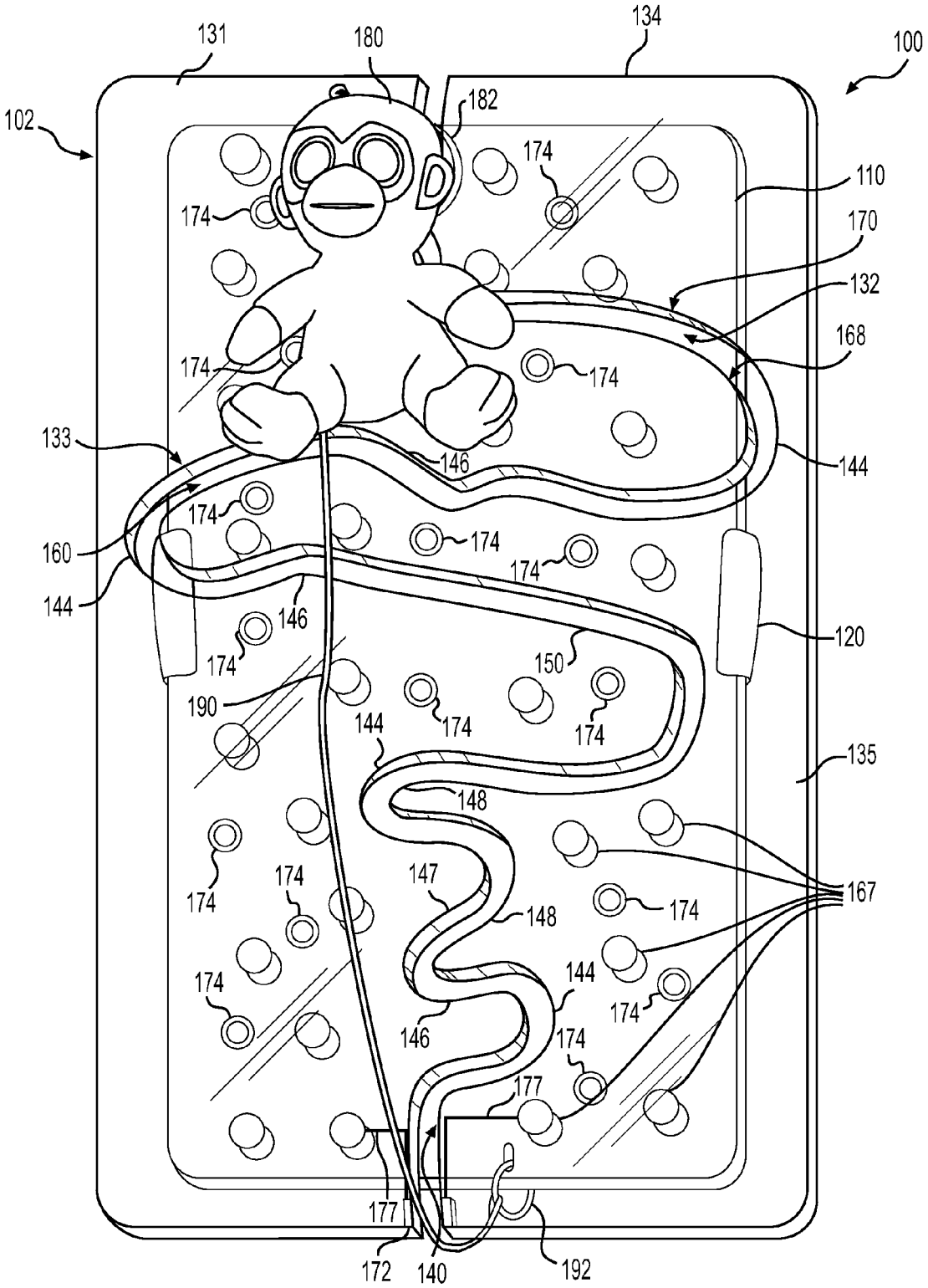
FIG. 7 is a perspective view of the game system shown in FIG. 1 with the playing figure in a starting position with the retainer engaging a seat formed in the track of the template on the game platform.

As shown in FIGS. 5A and 5B, the playing figure 180 can include a retainer 182 attached to a portion thereof, such as the back of the head of the playing figure 180 or at another convenient attachment point. The retainer 182 is configured to engage the template 130 of the game platform 102 so as to allow the movement of the playing figure 180 along the track 133 of the game system 100. The retainer 182 can be aligned on the playing figure 180 so that the center of mass of the playing figure 180 is disposed off center from the point of attachment, resulting in an unstable orientation of the playing figure 180 when movably connected to the track 133. The unstable alignment of the playing figure 180 thereby allows the playing figure 180 to move along the tortuous path 160 via gravity. The retainer 182 can comprise a retention base 183 from which extends a retention post 184 that supports a flange 186. When the playing figure 180 is positioned for play on the game platform 102, as shown in FIG. 7, the retention post 184 can be disposed in the channel 132 of the track 133 between the first side wall 168 formed on the first template piece 131 and the second side wall 170 formed on the second template piece 135. The flange 186 can engage the interior surfaces of the first and the second template pieces 131 and 135 to maintain the engagement of the playing figure 180 with the game platform 102, while allowing the playing figure 180 to move along the tortuous path 160. The unbalanced alignment of the center of mass of the playing figure 160 relative to the retainer 182 can be further accentuated by adding a weighted material 188 to a lower portion of the playing figure 180. The weighted material can be any suitably dense material, such as metal, sand, plastic, that adds weight at the desired section of the playing figure 180.

Figure 6:
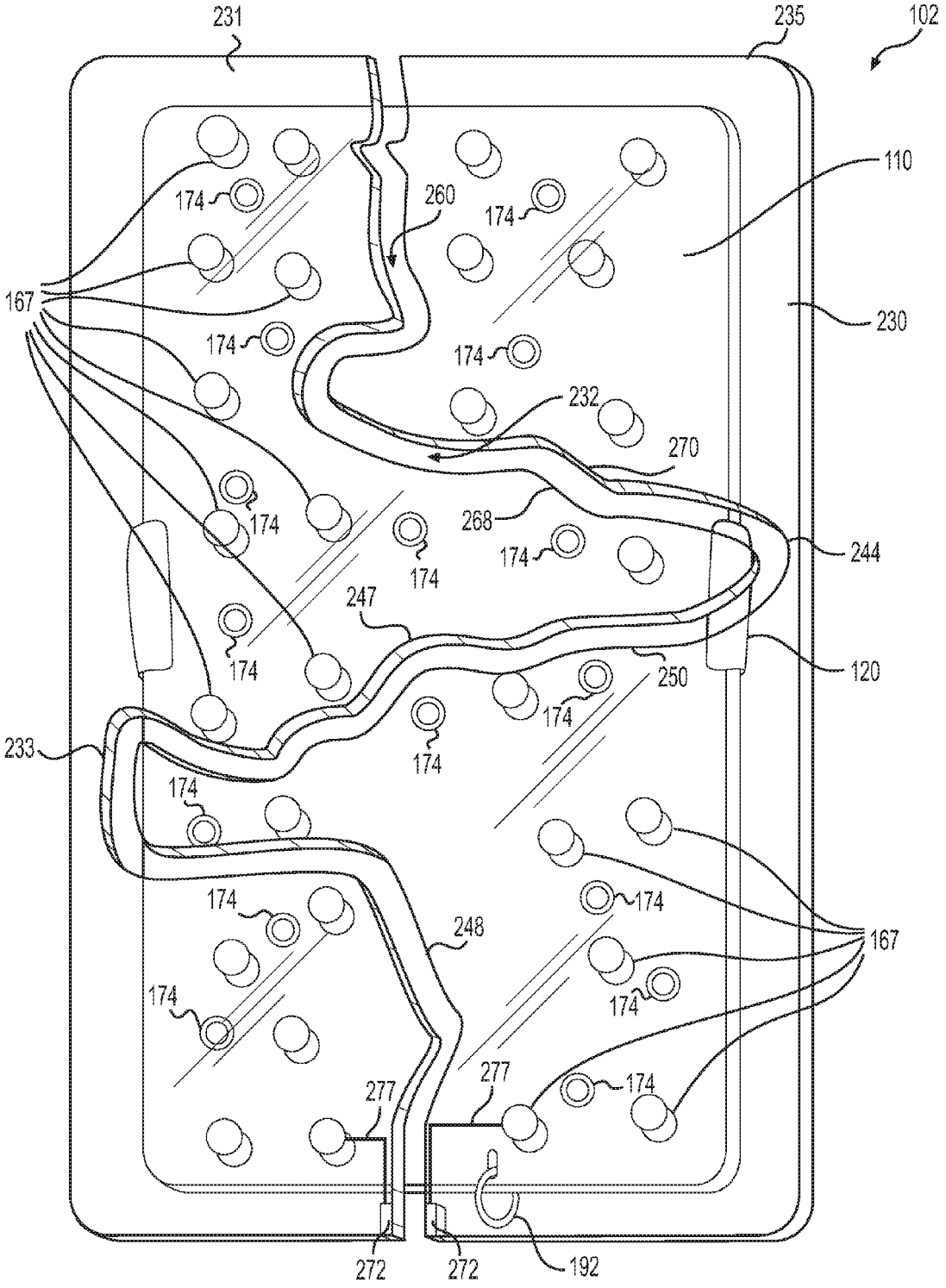
FIG. 6 is a perspective view of the game platform shown in FIG. 1 with a second template mounted on the base in place of the detachable first template shown in FIG. 1.

FIG. 6 shows the game platform 102 with a second template 230 detachably connected to the base 110. The second template 230 includes a track 233 that has a tortuous path 260 that differs from the path 160 of the template 130 in that it does not include as many challenging features, thereby allowing a player with a lower skill level to play effectively. The second template 230 includes a first template piece 231 and a second template piece 235 that connect to the base 110 by a variety of connectors 167. The first and the second template pieces 231 and 235, when mounted to the base 110, cooperate to form a channel 232 that defines the tortuous path 260 of the track 233 along which the playing figure 180 of the game system 100 can travel. The channel 232 is defined by a first side wall 268 and a second side wall 270 and can include a variety of features such as drops 248, slopes 250, bends 244 and meanders 247, but the path 260 can include fewer challenging features, such as rises, thereby reducing the overall difficulty of game play when using the second template 230. The game system 100 can include multiple templates 130 and 230 that can be detachably connected to the base 110, thereby allowing for different levels of difficulty and providing a means by which players of different ages and/or levels of agility or mobility to compete. Based on the skill level of the player, a template 130 or 230 of appropriate difficulty can be selected and mounted on the base 110. The second template 230 also includes sensors 272 connected by wires 277 to the lights 174 to provide for activation of the lights 174 when the playing figure 180 has completed the course.

FIG. 7 shows the playing figure 180 positioned in the starting position with the retention post 184 disposed in the channel 132 and resting on the starting seat 142. The playing figure 180 can thereby move along the tortuous path 160 of the track 133 as the game play progresses, eventually moving to the finish position where the sensors 172 are located, thereby activating the sensors 172 that, in turn, activate the lights 174 or other alarms mounted on the base 110 of the game platform 110.

Figure 8:
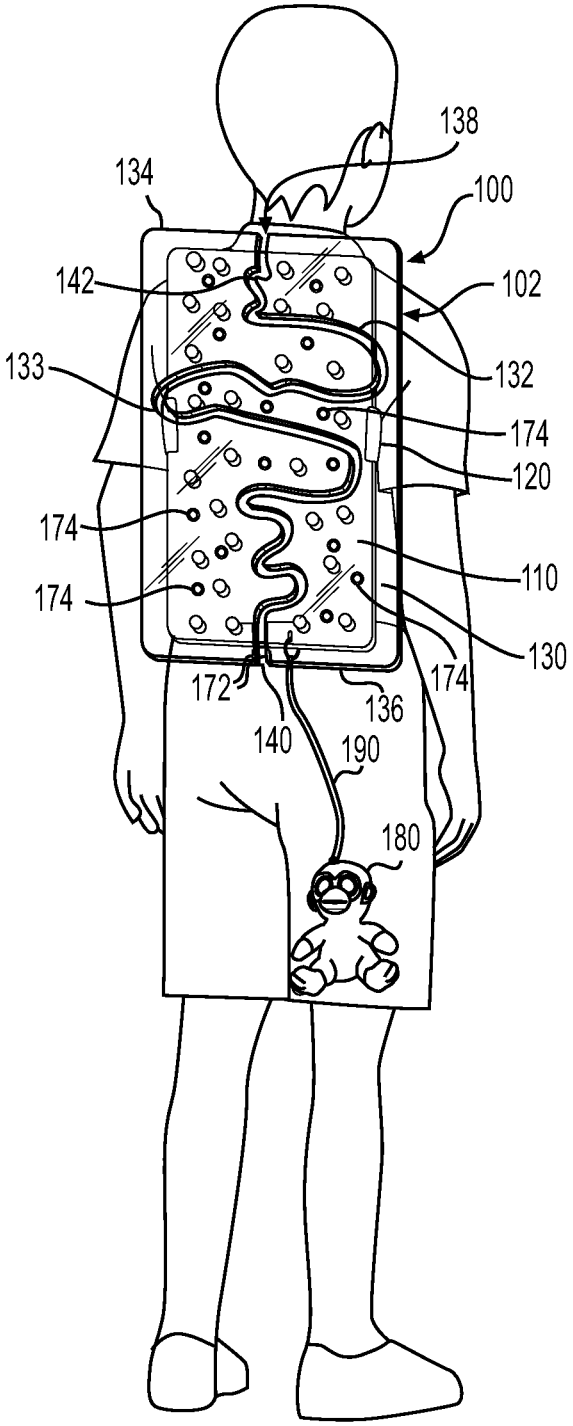
FIG. 8 is a perspective view of a player with the game system shown in FIG. 1 strapped to the player's back.

FIG. 8 shows the game system 100 mounted on a player's back. The game system 100 is so mounted by wrapping the body connector 120 around the player's torso and then adjusting and securing the body connector 120 so that the game platform 102 remains securely positioned on the player's back during game play. When the player is ready to play, the playing figure 180 can be placed into position by inserting the retention post 184 into the first opening 138 of the channel 132 and then moved into a stable position where the retention post 184 is resting on the seat 142, which serves as a starting point for game play. When game play commences, the player moves his or her body in an appropriate manner to adjust the orientation of the game platform 102 to cause the retention post 184 to move from the seat 142. Due to the center of mass of the playing figure 180 being unstably aligned with the retainer 182, the playing figure 180 will tend to be drawn downward by gravity. By body movement using major muscle groups and gross motor skills, the player can alter the orientation of the game platform 102, thereby providing a means by which gravity can draw the playing figure 180 along the path 160. The flange 186 engages the first and the second template pieces 131 and 135, thereby preventing the playing figure 180 from separating from the game platform 102 while the playing figure 180 is moving along the path 160. As the playing figure 180 moves along the path 160, the playing figure 180 eventually reaches the game finish position where the sensors 172 are aligned. The sensors 172 will activate as the playing figure 180 comes into position, thereby causing one or more alarms, such as battery-operated lights 174, disposed on the game platform 102 to be activated, thereby notifying the player and the other game participants that the player has completed the game play. Furthermore, the alignment of the game platform 102 and the playing figure 180 on the player's back allows for a more significant role to be played by game spectators. With this alignment of the game platform 102, the player has a limited ability to discern where along the path 160 the playing figure 180 is located at any given point in time and how best to move his or her body to facilitate the progress of the playing figure 180 along the path 160. Consequently, spectators can be involved indirectly in game play in providing guidance on how to move the player's body to facilitate the playing figure 160 progress and general encouragement to the player, thereby potentially enhancing the game play experience for both the player and spectators.

The embodiments set forth herein are provided to illustrate the scope of the present disclosure, but are not provided to limit the scope thereof. The present disclosure contemplates alternative combinations and modifications of the features disclosed herein without departing from the scope thereof. Alternatives, variations and modifications of the embodiments described herein will be apparent to one of ordinary skill in the art and are encompassed by the present disclosure.

The invention claimed is:

1. A game system comprising:

a game platform comprising a base, an adjustable strap attached to the base, and a template detachably connected to the base, wherein the adjustable strap is capable of wrapping around a player's torso and securely mounting the game platform on a player's back, wherein the template comprises a plurality of pieces; wherein the plurality of pieces comprises a first template piece detachably connected to the base by connectors which maintain clearance between the first template piece and the base and a second template piece detachably connected to the base by connectors which maintain clearance between the second template piece and the base, wherein the first template piece comprises a first side wall and the second template piece comprises a second side wall, wherein the first template piece and the second template piece cooperate to form a channel, wherein the channel is spaced apart from the base and is defined by the first side wall and the second side wall, wherein the channel comprises a first opening formed in a first side of the template and a second opening formed in a second side of the template, wherein the channel forms a track disposed on the game platform, wherein the track comprises a seat disposed in the channel and formed on the second side wall of the second template piece, wherein the seat is aligned proximal to the first opening and distal to the second opening; and, a playing figure movably connected for play to the game platform by a retainer, wherein the retainer comprises a retention base, a retention post extending from the retention base, and a flange attached to the retention post, wherein the retention post is disposed in the channel, and wherein the flange is disposed between the base and the template and engages the first template piece and the second template piece, wherein the clearance between the template and the base allows movement of the flange along the track, wherein the playing figure comprises a center of mass, wherein the center of mass is disposed off center from the retention base, wherein the playing figure is movable along the track via gravity for play as the game platform is mounted on a player's back and the orientation of the game platform is altered during game play, wherein the retainer is detachable from the template at the first opening and the second opening, and wherein at a start of game play the retainer rests on the seat.

2. The game system of claim 1, further comprising a light disposed on the game platform.

3. The game system of claim 2, wherein the light is disposed on the base, and wherein the template is translucent.

4. The game system of claim 1, further comprising a sensor operably aligned with a portion of the channel.

5. The game system of claim 4, wherein the sensor is operably connected to an alarm mounted on the base.

6. The game system of claim 5, wherein the sensor is operably aligned with the second opening of the channel.

7. The game system of claim 1, wherein the playing figure is connected to the game platform by a flexible connector.

* * * * *